US009840962B2

(12) United States Patent
Gonze et al.

(10) Patent No.: US 9,840,962 B2
(45) Date of Patent: Dec. 12, 2017

(54) SYSTEM AND METHOD FOR CONTROLLING INLET COOLANT TEMPERATURE OF AN INTERNAL COMBUSTION ENGINE

(71) Applicant: GM Global Technology Operations LLC, Detroit, MI (US)

(72) Inventors: Eugene V. Gonze, Pickney, MI (US); Yue-Ming Chen, Ann Arbor, MI (US); Vijay Ramappan, Novi, MI (US); Sanjeev M. Naik, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 112 days.

(21) Appl. No.: 14/877,112

(22) Filed: Oct. 7, 2015

(65) Prior Publication Data

US 2016/0376978 A1 Dec. 29, 2016

Related U.S. Application Data

(60) Provisional application No. 62/184,502, filed on Jun. 25, 2015.

(51) Int. Cl.
*F01P 7/16* (2006.01)
*F01P 7/14* (2006.01)

(52) U.S. Cl.
CPC ..... *F01P 7/167* (2013.01); *F01P 2007/146* (2013.01); *F01P 2037/00* (2013.01)

(58) Field of Classification Search
CPC ..... F01P 7/167; F01P 2007/146; F01P 3/20; F01P 2023/08; F01P 2037/00; F01P 7/14
See application file for complete search history.

(56) References Cited

U.S. PATENT DOCUMENTS 5,390,632 A * 2/1995 Ikebe ..... F01P 7/164 123/41.02
6,424,906 B1 * 7/2002 Zhu ..... F02D 41/1401 700/34
6,817,321 B2 * 11/2004 Takei ..... F01P 7/167 123/41.09
7,171,927 B2 * 2/2007 Sano ..... F01P 7/048 123/41.1
7,320,434 B2 * 1/2008 Suda ..... F01P 7/167 123/41.02
8,100,096 B2 * 1/2012 Dolker ..... F02B 29/0443 123/41.08

(Continued)

*Primary Examiner* — Long T Tran

(57) ABSTRACT

A system including a target module determining a target temperature of coolant at an input of an engine for a maximum amount of fuel efficiency. A mode module disables closed loop control based on temperatures of coolant entering the engine and at an output of a radiator. An open loop module determines first and second temperatures of coolant at inputs of a coolant control valve that receive coolant from the radiator and a channel that bypasses the radiator. A ratio module determines a ratio based on the first and second temperatures and the temperatures of the coolant entering the engine and at the radiator output. A closed loop module generates a correction value based on the target temperature and the temperature of the coolant entering the engine. A position module adjusts the coolant control valve based on the ratio, the correction value and whether closed loop control is disabled.

20 Claims, 3 Drawing Sheets

(56) References Cited

U.S. PATENT DOCUMENTS

| | | | | |
|---|---|---|---|---|
| 8,443,766 | B2 * | 5/2013 | Dolker | F02B 29/0493 123/198 D |
| 8,452,522 | B2 * | 5/2013 | Gao | F02D 41/2422 123/406.33 |
| 8,601,813 | B2 * | 12/2013 | Shutty | F02D 41/0072 60/605.2 |
| 2004/0237911 | A1 * | 12/2004 | Sano | F01P 7/048 123/41.1 |

* cited by examiner

SYSTEM AND METHOD FOR CONTROLLING INLET COOLANT TEMPERATURE OF AN INTERNAL COMBUSTION ENGINE

CROSS-REFERENCE TO RELATED APPLICATIONS

This application claims the benefit of U.S. Provisional Application No. 62/184,502, filed on Jun. 25, 2015. The disclosure of the above application is incorporated herein by reference in its entirety.

FIELD

The present disclosure relates to cooling systems for internal combustion engines, and more particularly to systems for controlling temperatures of an engine.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Coolant is circulated through one or more cylinder heads of the engine and an engine block and may also be circulated through an integrated exhaust manifold. The temperature and/or flow rate of the coolant may be adjusted to control cooling of the engine, engine block, and integrated exhaust manifold and/or maintain predetermined temperatures of the engine, engine block and integrated exhaust manifold. The predetermined temperatures may be maintained to maximize fuel efficiency of the engine.

SUMMARY

A system is provided that includes a target module, a mode module, an open loop module, a ratio module, a closed loop module and a position module. The target module is configured to determine a target temperature of coolant at an input of an engine for a maximum amount of fuel efficiency. The mode module is configured to disable closed loop control based on a temperature of coolant entering the engine and a temperature of coolant at an output of a radiator. The open loop module is configured to determine (i) a first temperature of coolant at a first input of a coolant control valve, and (ii) a second temperature of coolant at a second input of the coolant control valve. The first input receives coolant from the radiator. The second input receives coolant from a channel that bypasses the radiator. The ratio module is configured to determine a ratio based on the temperature of the coolant entering the engine, the temperature of the coolant at the output of the radiator, the first temperature and the second temperature. The closed loop module is configured to, based on whether closed loop control is disabled, generate a correction value based on the target temperature and the temperature of the coolant entering the engine. The position module is configured to adjust a position of the coolant control valve based on the ratio, the correction value and whether closed loop control is disabled.

In other features, a method is provided and includes: determining a target temperature of coolant at an input of an engine for a maximum amount of fuel efficiency; disabling closed loop control based on a temperature of coolant entering the engine and a temperature of coolant at an output of a radiator; and determining (i) a first temperature of coolant at a first input of a coolant control valve, and (ii) a second temperature of coolant at a second input of the coolant control valve. The first input receives coolant from the radiator. The second input receives coolant from a channel that bypasses the radiator. The method further includes: determining a ratio based on the temperature of the coolant entering the engine, the temperature of the coolant at the output of the radiator, the first temperature and the second temperature; based on whether closed loop control is disabled, generating a correction value based on the target temperature and the temperature of the coolant entering the engine; and adjusting a position of the coolant control valve based on the ratio, the correction value and whether closed loop control is disabled.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Coolant flow rates and temperatures of an engine including temperatures of coolant entering an engine can vary during operation of the engine. This variation can affect fuel efficiency of the engine. Systems and methods are disclosed herein for controlling the temperature of the coolant received at an input of an engine. This includes reducing an inlet coolant temperature of an engine while maintaining an outlet coolant temperature of the engine to provide an increased temperature difference $\Delta t$ between the inlet coolant temperature and the outlet coolant temperature. Providing an increased temperature difference $\Delta t$ can improve fuel efficiency of an engine. Reducing the inlet coolant temperature while maintaining the outlet coolant temperature allows a flow rate of the coolant to be decreased. With a reduced inlet coolant temperature, a smaller flow rate is needed to transfer a predetermined amount of heat between the engine and the coolant to maintain the engine coolant outlet temperature. Decreasing the flow rate allows cylinder walls of the engine to stay at higher temperatures as compared to higher coolant flow rates. By maintaining the cylinder walls at higher temperatures, fuel efficiency of the engine is increased.

Systems and methods according to the present disclosure control temperatures of coolant entering an engine to maintain controllable coolant pump flow rates for precise control of cylinder wall and/or combustion chamber temperatures. This aids in maintaining maximum fuel efficiency of the engine. A cooling system valve and an electric pump are controlled based on output signals received from sensors to provide improved coolant mixing conditions to maintain a target temperature of coolant entering the engine. A coolant control valve is controlled to adjust mixing of a coolant passing through a radiator and coolant bypassing the radiator to control the temperature of the coolant entering the engine.

Figure 1:
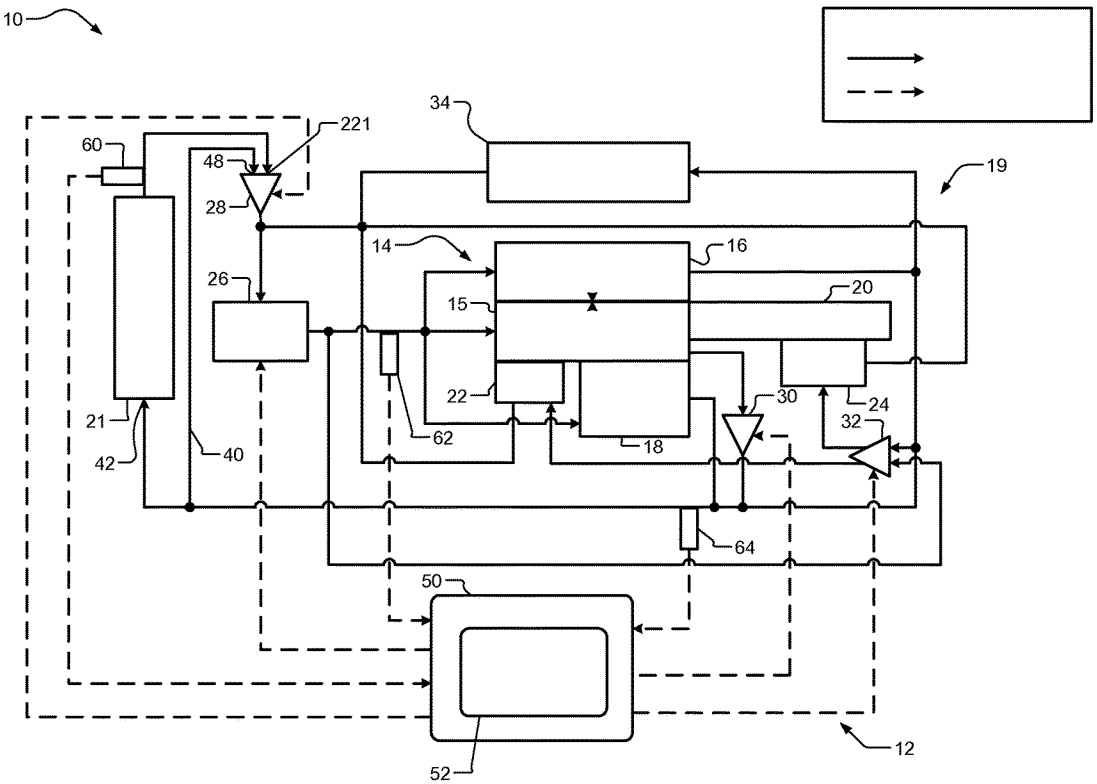
FIG. 1 is a functional block diagram of an engine system and corresponding temperature control system incorporating an engine temperature module in accordance with an aspect of the present disclosure.

FIG. 1 shows an engine system 10 and corresponding temperature control system 12. The engine system 10 includes an engine 14 with an engine block 15, one or more cylinder heads (a single head 16 is shown) and an integrated exhaust manifold 18. The engine 14 is connected to a transmission 20. The heads, engine block 15 and the integrated exhaust manifold 18 are cooled by a coolant circulating through channels of conduits of a coolant flow circuit 19 and between (i) a radiator 21 and (ii) the heads, the engine block 15 and the integrated exhaust manifold 18. The heads, engine block 15 and integrated exhaust manifold 18 have respective coolant jackets (or coolant channels). The engine block and transmission may also be cooled respectively via an engine oil cooler 22 and a transmission oil cooler 24. Oil may be circulated between (i) the engine 14 and the transmission 20 and (ii) the oil coolers 22, 24.

The engine system 10 may further include an electric pump 26, a coolant control valve (CCV) 28, a block valve 30, an oil valve 32, and a heater core 34. Coolant channels are provided between (i) the CCV 28 and (ii) the radiator 21, the electric pump 26, the heater core 34 (may be implemented as a heat exchanger), the heads, the engine block 15, the integrated exhaust manifold 18, the engine oil cooler 22, and the transmission oil cooler 24. A bypass channel 40 exists between (i) an input 42 of the radiator 21 and (ii) an output 44 of the engine block 15, an output 46 of the integrated exhaust manifold 18, and an input 48 of the CCV 28. During operation, coolant flows out of the electric pump 26 and is provided to the heads, the engine block 15, the integrated exhaust manifold 18, the oil valve 32, and the heater core 34. Coolant out of the heads is passed through the heater core 34 and is also provided to the oil valve 32. The oil valve 32 provides the coolant to the engine oil cooler 22 and to the transmission oil cooler 24. Coolant out of the engine oil cooler 22, the transmission oil cooler 24, and the heater core 34 is provided back to the electric pump 26. Coolant out of the engine block 15 and the integrated exhaust manifold 18 is provided to the block valve 30, which in turn provides the coolant back to the radiator 21.

The temperature control system 12 includes an engine control module 50 that includes an engine temperature module 52. The engine temperature module 52 controls temperatures of coolant entering and exiting the engine 14. This includes temperatures of coolant entering and exiting the heads, the engine block 15 and the integrated exhaust manifold 18. This temperature control may be based on signals from various sensors and/or various parameters. As shown, the temperature control system 12 includes temperature sensors 60, 62, 64, which detect coolant temperatures of coolant out of the radiator $T_{RADOUT}$, received at the engine 14 $T_{ENGIN}$, and out of the engine 14 $T_{ENGOUT}$. The sensors 60, 62, 64 may be connected to respective ones of the conduits. The engine control module 50 controls operation of the electric pump 26 and the valves 28, 30, 32 based on the signals and parameters (e.g., the temperatures $T_{RADOUT}$, $T_{ENGIN}$, $T_{ENGOUT}$).

Figure 2:
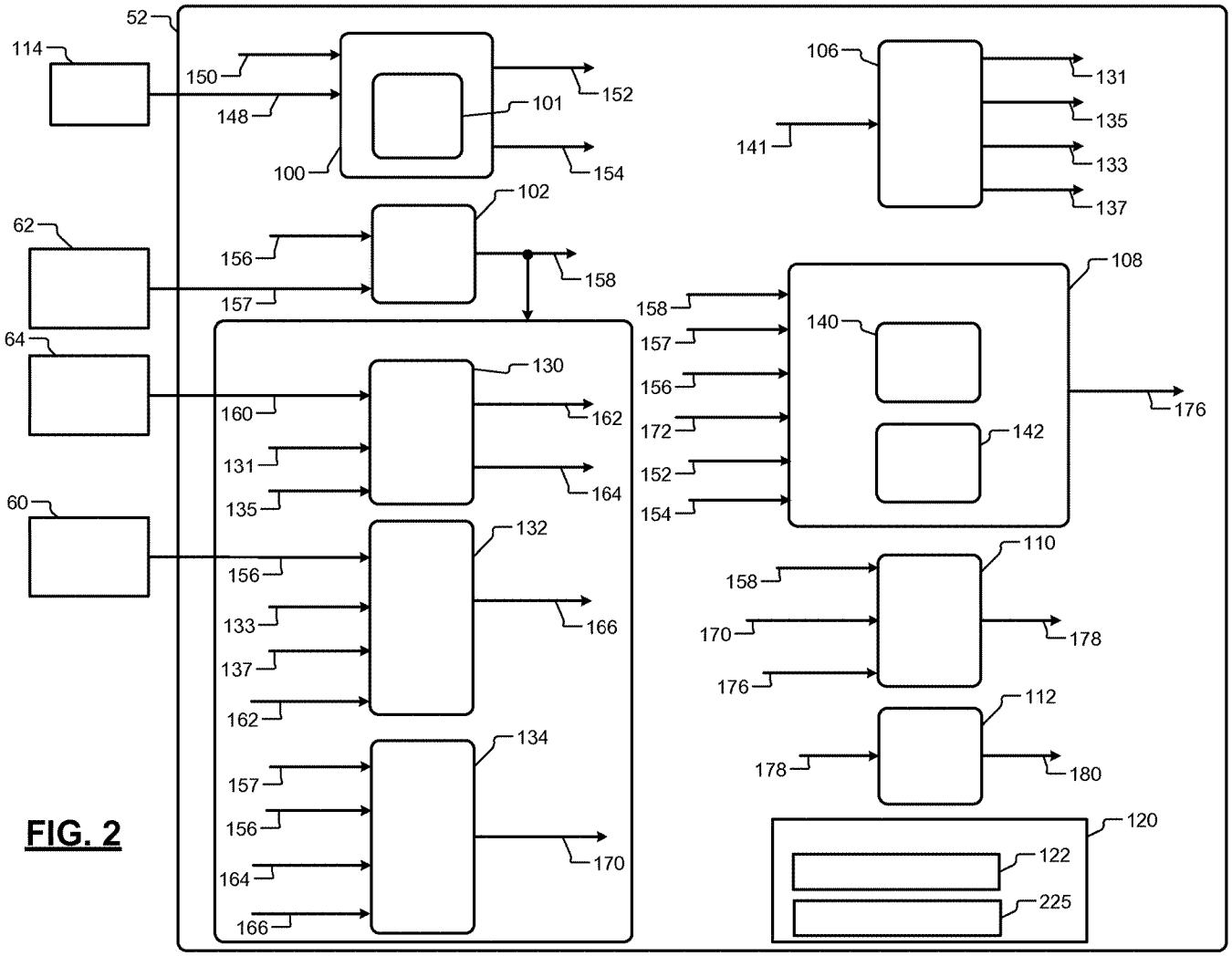
FIG. 2 is a functional block diagram of the engine temperature module of FIG. 1.

Referring now also to FIG. 2, which shows the engine temperature module 52, which includes a target module 100, a mode module 102, an open loop module (sometimes referred to as an enthalpy module) 104, a flow module 106, a closed loop module 108, a summing module 110 and a CCV position module 112. The target module 100 may include a power module 101. The engine temperature module 52 may receive signals from various sensors, such as from the sensors 60, 62, 64. The engine temperature module 52 may receive signals from other sensors, such as a speed sensor 114 or other sensors of the engine system 10. Operation of the engine temperature module 52 and corresponding modules is described below with respect to the method of FIG. 3. For further defined structure of the engine temperature module 52 and corresponding modules see below provided definition for the term "module".

The engine temperature module 52 may include a memory 120. As an alternative, the memory 120 may be external to the engine temperature module 52 and may be accessed by the engine temperature module 52. The memory 120 may store maps, tables, algorithms, etc. used by the modules 100, 101, 102, 104, 106, 108, 110, 112. As an example, the memory 120 may store tables, maps, and/or equations (designated target lookup tools 122) relating (i) power output of an engine, to (ii) a target coolant flow rate of the engine $FLOW_{TAR}$ and a target inlet coolant temperature $T_{ENGTargIN}$ of the engine for maximum fuel efficiency. As another example, the memory 120 may store tables 124 relating (i) different CCV and engine combinations and corrected ratio values, to (ii) positions for the corresponding CCV. These relationships are further described below.

The open loop module 104 may include an engine delay module 130, a radiator delay module 132 and a ratio module 134. The closed loop module 108 may include an error module 140 and a proportional-integral-derivative (PID) module 142. The PID module 142 may include and/or be implemented as a PID controller. The PID module 142 may include integrators 144.

Figure 3:
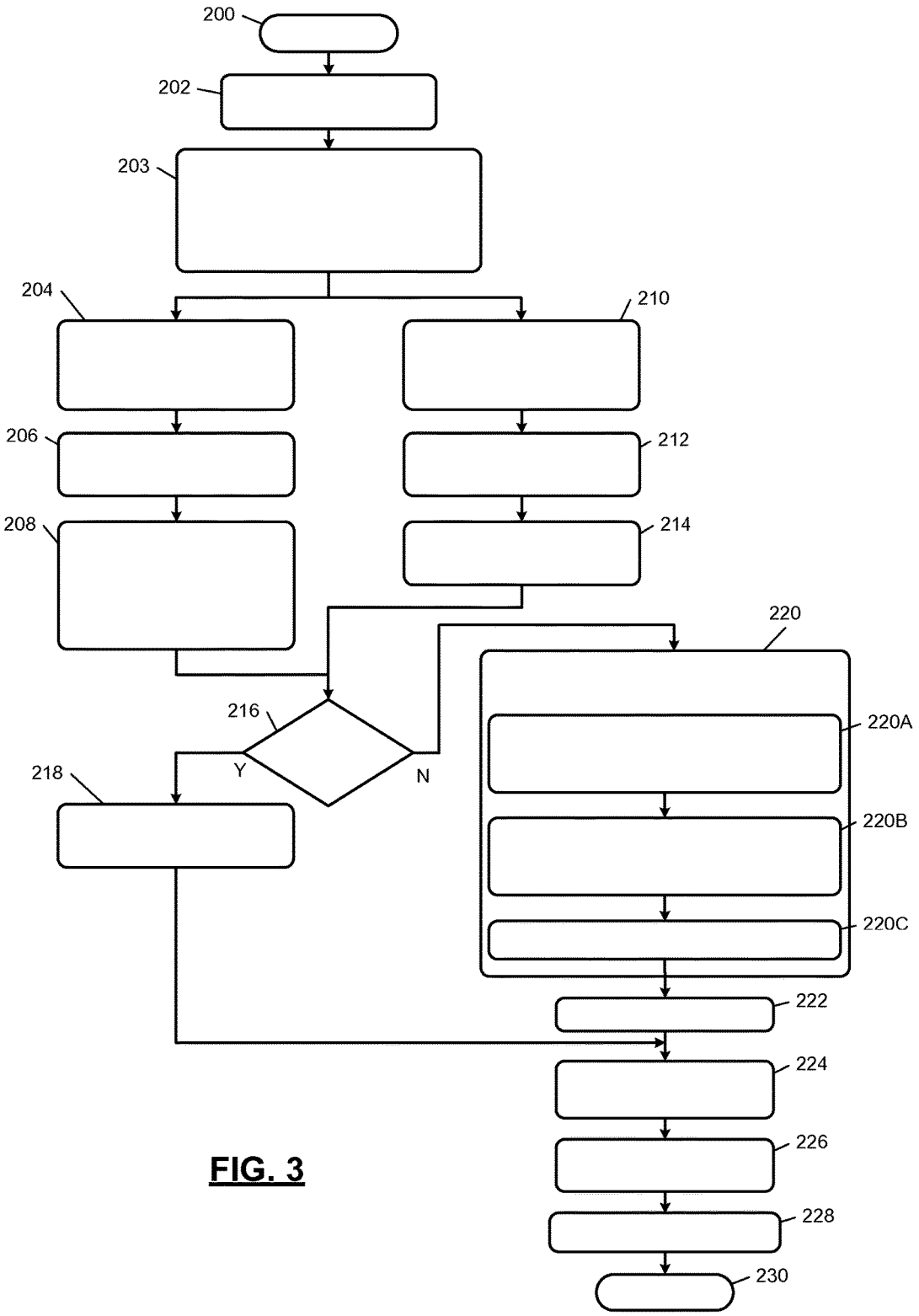
FIG. 3 is a flow diagram illustrating a temperature control method for an inlet coolant of an engine in accordance with an aspect of the present disclosure.

The systems disclosed herein may be operated using numerous methods, an example method is illustrated in FIG. 3. In FIG. 3, a temperature control method for an inlet coolant of an engine is shown. Although the following tasks are primarily described with respect to the implementations of FIGS. 1-2, the tasks may be easily modified to apply to other implementations of the present disclosure. The tasks may be iteratively performed. Each of the following tasks may be performed by the engine temperature module (ETM) 52 and/or by one or more of the modules 100, 102, 104, 106, 108, 110, 112.

The method may begin at 200. At 202, the ETM 52 receives signals from the sensors 60, 62, 64 114 and/or other sensors. The signals are indicative of engine speed RPM, coolant inlet temperature $T_{ENGIN}(t)$ of the engine 14, coolant outlet temperature $T_{ENGOUT}(t)$ of the engine 14, and coolant outlet temperature $T_{RAD}(t)$ of the radiator 21.

At 203, the flow module 106 may determine a coolant flow rate $\dot{m}_{BYP}$ (signal 131) in the bypass channel 40, a coolant flow rate $\dot{m}_{RAD}$ (signal 133) through the radiator 21, a volume $VOL_{BYP}$ (signal 135) of coolant passing from the bypass channel 40 within a predetermined period of time, and a volume $VOL_{RAD}$ (signal 137) of coolant passing from the radiator 21 within the predetermined period of time. The flow rates $\dot{m}_{BYP}$, $\dot{m}_{RAD}$ may be measured in, for examples, liters per minute. The flow rates $\dot{m}_{BYP}$, $\dot{m}_{RAD}$ and the volumes $VOL_{BYP}$, $VOL_{RAD}$ may be determined based on a speed PUMPSPD (signal 141) of the electric pump 26.

At 204, the target module 100 receives an engine speed signal 148 from the speed sensor 114 and a torque signal 150, which indicates an output torque $Torque_{ACT}$ of the engine 14 and determines the engine speed and the torque output of the engine 14. The engine speed signal 148 indicates an engine speed RPM. The target module 100 may alternatively determine the torque output of the engine 14 based on operating parameters (e.g., speed, air/fuel ratio, throttle position, etc.) of the engine 14.

At 206, the power module 101 may determine a power output of the engine 14 based on the torque output $Torque_{ACT}$ and the engine speed RPM. This may be performed using equation 1.

$$Power=F\{Torque_{ACT},RPM\} \quad (1)$$

At 208, the target module 100 may select one or more of the target look-up tools 122 based on the power output of the engine 14. The target module 100 may then determine a target flow rate $\dot{m}_{TAR}$ (signal 152) and a target coolant inlet temperature of the engine $T_{ENGTargIN}$ (signal 154) based on the one or more selected target lookup tools 122, the output torque $Torque_{ACT}$ and the engine speed RPM. The targets $\dot{m}_{TAR}$, $T_{ENGTargIN}$ may be determined based on equation 2 relating a combustion temperature $T_{COMB}$ to the $\dot{m}_{TAR}$, $T_{ENGTargIN}$, $Torque_{ACT}$ and RPM. The relationship between these parameters is based on the heat transfer equation 3, where $\dot{Q}$ is heat rejection energy of the engine 14, iii is coolant flow rate of the engine 14, c is a heat constant, and $\Delta t$ is a difference in temperature across the engine 14. The heat rejection energy $\dot{Q}$ is a function of $Torque_{ACT}$ and RPM. The combustion temperature $T_{COMB}$ is a temperature at which maximum fuel efficiency is provided without engine knock. This allows energy to remain in cylinders of the engine 14 while minimizing energy transfer to walls of the cylinders.

$$T_{COMB}=F\{FLOW_{ENG}, T_{ENGtargIN}, Torque_{ACT},RPM\} \quad (2)$$

$$\dot{Q}=\dot{m}c\Delta t \quad (3)$$

In addition or as an alternative to performing tasks 204, 206, 208, the following tasks 210, 212, 214 may be performed At 210, the target module 100 may determine a target coolant output temperature $T_{ENGTargOUT}$ of the engine 14. The target coolant output temperature $T_{ENGTargOUT}$ may be determined based on, for example, a temperature of the engine 14 (e.g., a current coolant temperature, a current oil temperature, a temperature of an engine block, etc.). If the temperature of the engine 14 is less than a predetermined temperature, then a first target coolant output temperature $T_{ENGTargOUT}$ may be selected. If the temperature of the engine 14 is greater than or equal to the predetermined temperature, then a second target coolant output temperature $T_{ENGTargOUT}$ may be selected. The first target coolant output temperature $T_{ENGTargOUT}$ may be greater than the second target coolant output temperature $T_{ENGTargOUT}$ to promote warm up of the engine 14, for example, during a cold start.

At 212, the target module 100 may determine a difference between coolant inlet and outlet temperatures $\Delta t$ of the engine 14. This may be done using, for example, equation 4. The difference between coolant inlet and outlet temperatures $\Delta t$ may be determined as a function of a load $Load_{ENG}$ on the engine 14 and the speed RPM of the engine 14. As an alternative, the difference between coolant inlet and outlet temperatures $\Delta t$ may be determined as a function of the torque output $Torque_{ACT}$ on the engine 14 and the speed RPM of the engine 14. The difference between coolant inlet and outlet temperatures $\Delta t$ may be determined using tables, maps, equations, etc. stored in the memory 120 and may be determined for maximum fuel efficiency.

$$\Delta t_{ENG}=F\{Load_{ENG},RPM\}=T_{ENGOUT}(t)-T_{ENGIN}(t) \quad (4)$$

At 214, the target module 100 may determine a target coolant inlet temperature $T_{ENGTargetIN}$ of the engine 14 based on the selected target coolant output temperature $T_{ENGTargOUT}$ determined at 210 and the difference between coolant inlet and outlet temperatures $\Delta t$. This may be done using equation 4.

At 216, the mode module 102 determines whether the measured temperature $T_{RAD}(t)$, of the coolant flowing out of the radiator 21 and as indicated by a radiator output signal 156, is greater than or equal to the measured inlet coolant temperature $T_{ENGIN}(t)$ of the engine 14. The inlet coolant temperature $T_{ENGIN}(t)$ is indicated by signal 157. Task 218 is performed if $T_{RAD}(t)$ is greater than or equal to $T_{ENGIN}(t)$. Task 220 is performed if $T_{RAD}(t)$ is less than $T_{ENGIN}(t)$. The mode module 102 may generate a mode signal 158 indicating the operating mode, such as a full radiator output mode or a partial radiator output mode. The mode module 102 may generate a mode signal 158 indicating the operating mode, such as a full radiator output mode or a partial radiator output mode. The full radiator output mode includes performing task 218. The partial radiator output mode includes performing tasks 220-222.

At 218, the mode module 102 and/or the engine temperature module 52 may set an uncorrected ratio signal $RATIO_{UNCOR}$ to 100%. This causes the CCV 28 to transition to a fully open position at task 230 whereby the CCV receives coolant from the radiator 21 and not from the bypass channel 40.

At 220, the open loop module 104 performs open loop tasks to determine an open percentage for the CCV 28 (i.e. a percentage of coolant flow out of the CCV that was received from the radiator 21 as opposed to the bypass channel 40). The CCV 28 controls the mixing of coolant from the radiator 21 and the bypass channel 40. The higher the open percentage the more coolant is passed from the radiator 21 through the CCV 28. The open percentage is indicated as the uncorrected ratio signal $RATIO_{UNCOR}$.

At 220A, the engine delay module 130 determines delayed temperatures associated with coolant to pass from the output of the engine 14 to (i) the input of the radiator 21, and (ii) the input of the CCV 28 via the bypass channel 40. The temperature for the coolant at the input of the radiator 21 is designated $T_{ENGOUT}(t-d1)$, where d1 is delay time for the coolant to pass from the output of the engine 14 to the input of the radiator 21. The temperature of the coolant at the input of the CCV 28 and output of the bypass channel 40 is $T_{ENGOUT}(t-d2)$, where d2 is delay time for coolant to pass from the output of the engine 14, through the bypass channel 40 and to the input of the CCV 28. The temperature $T_{ENGOUT}(t-d2)$ may be determined according to equation 5.

$$T_{ENGOUT}(t-d2)=F\{\dot{m}_{BYP},VOL_{BYP}\} \quad (5)$$

Signals 162, 164 indicate respectively $T_{ENGOUT}(t-d1)$ and $T_{ENGOUT}(t-d2)$ The determinations of $T_{ENGOUT}(t-d1)$ and $T_{ENGOUT}(t-d2)$ may be based on $T_{ENGOUT}(t)$, $\dot{m}_{BYP}$, and $VOL_{BYP}$.

At 220B, the radiator delay module 132 determines a third delayed temperature $T_{RADOUT}(t-d3)$ of coolant at a second input 221 of the CCV 28. Signal 166 indicates $T_{RADOUT}$ (t−d3). Temperature $T_{RADOUT}$ (t−d3) may be determined according to equation 6.

$$T_{RAD}(t-d3)=F\{\dot{m}_{RAD},\mathrm{VOL}_{RAD}\} \quad (6)$$

The temperature of the coolant at the second input 221 may be determined based on $T_{RAD}(t)$, $\dot{m}_{RAD}$, $\mathrm{VOL}_{RAD}$, and $T_{ENGOUT}$(t−d1). The delayed temperatures $T_{ENGOUT}$ (t−d1), $T_{ENGOUT}$ (t−d2), $T_{RADOUT}$(t−d3) may be used to estimate a temperature $T_{CCVOUT}(t)$ of coolant out of the coolant control valve 28.

At 220C, the ratio module 134 determines the uncorrected ratio $\mathrm{RATIO}_{UNCOR}$ based on the $T_{ENGOUT}(t)$, $T_{RAD}(t)$, $T_{ENGOUT}$(t−d2), and $T_{RADOUT}$(t−d3). The ratio module 134 may determine a bypass flow rate percentage $\mathrm{FLOW}_{BYP}(t)$ for the CCV 28 and according to equation 7.

$$FLOW_{BYP}(t)=\frac{T_{ENGT\,arg\,IN}(t)-T_{RAD}(t-d3)}{T_{ENGOUT}(t-d2)-T_{RAD}(t-d3)} \quad (7)$$

The uncorrected ratio may also be determined based on other parameters such as $T_{rtn}(t)$, $T_{CCVOUT}(t)$, $\dot{m}_{CCVOUT}(t)$ and $\dot{m}_{rtn}(t)$, where: $T_{rtn}(t)$ is an estimate of temperature of coolant being returned from the engine oil cooler 22; the transmission oil cooler 24 and the heater core 34 to the electric pump 26; $\dot{m}_{rtn}(t)$ is an estimate of flow rate of coolant being returned from the engine oil cooler 22, the transmission oil cooler 24 and the heater core 34 to the electric pump 26; and $\dot{m}_{CCVOUT}(t)$ is an estimate of flow rate of coolant out of the coolant control valve 28. The flow rates $\dot{m}_{CCVOUT}(t)$, $\dot{m}_{rtn}(t)$ may be determined by the flow module 106. The temperatures $T_{rtn}(t)$, $T_{CCVOUT}(t)$ may be determined by the open loop module 104.

The bypass flow rate percentage $\mathrm{FLOW}_{BYP}(t)$ refers to an amount of coolant flowing from the bypass channel 40 through the CCV 28 relative to an amount of coolant flowing from the radiator 21 through the CCV 28. The ratio module 134 may then determine the uncorrected ratio $\mathrm{RATIO}_{UNCOR}$ based on $\mathrm{FLOW}_{BYP}(t)$ and according to equation 8. The uncorrected ratio $\mathrm{RATIO}_{UNCOR}$ may be indicated by signal 170.

$$\mathrm{RATIO}_{UNCOR}=1-\mathrm{FLOW}_{BYP}(t) \quad (8)$$

At 222, the error module 140 determines error value. This error value may be a difference between $T_{ENGIN}(t)$ and $T_{ENGTargIN}(t)$ according to equation 9.

$$\mathrm{ERROR}=T_{ENGIN}(t)-T_{ENGTargIN} \quad (9)$$

At 224, the PID module 142 determines gains $K_P$, $K_I$ for proportional and integral portions of the PID module 142. This may be based on the ERROR. Tables stored in the memory 120 may be used to lookup the gains $K_P$, $K_I$ based on the ERROR. The higher the ERROR, the larger the values of the gains $K_P$, $K_I$. The gains $K_P$, $K_I$ may be asymmetric. The gains $K_P$, $K_I$ may be scaled when the temperature of the coolant out of the radiator 21 is less than a first predetermined temperature. The derivative portion of the PID module 142 may be disabled. The PID module 142 determines a correction value CORR based on the gains $K_P$, $K_I$, which may be indicated by signal 176. The PID module 142 may operate based on an oil cooling signal 172 indicating whether oil cooling is disabled or enabled and thus being performed by, for example, the engine oil cooler 22. For example, the integrators 144 of the PID module 142 may be reset to predetermined values when the oil cooling is enabled and/or when the oil cooling is disabled. The integrators 144 may also or alternatively be reset when the temperature of the coolant out of the radiator 21 is less than a second predetermined temperature. The second predetermined temperature may be less than the first predetermined temperature.

In certain conditions, the closed loop module 108 may be disabled such that the correction value CORR is 0 and/or $\mathrm{RATIO}_{UNCOR}$ is at 100%. This may occur when the mode signal 158 indicates that the closed loop control is disabled. This may also occur when comfort heating is requested and/or active (e.g., when heat within a cabin of a corresponding vehicle is ON). In order to provide heat within the cabin, a higher coolant inlet temperature and a smaller Δt may be provided. The closed loop module 108 may also be disabled when the electric pump 26 is OFF and/or not circulating coolant. This can prevent natural convection type heating through movement of coolant in the coolant flow circuit 19. The closed loop module 108 may also be disabled when the engine 14 is operating in a warm-up mode (a temperature of the engine is below a predetermined temperature), for example, subsequent to a cold start of the engine 14.

At 226, the summing module 110 generates a summation signal 178, which is a corrected version of $\mathrm{RATIO}_{UNCOR}$. The summation signal may indicate a summation SUM of $\mathrm{RATIO}_{UNCOR}$ and the correction value CORR. The correction value CORR in effect corrects the percentage provided by the $\mathrm{RATIO}_{UNCOR}$. The summation SUM may be determined according to equation 10. As an alternative, the correction value may be a multiplication factor (or weight) that is multiplied by the $\mathrm{RATIO}_{UNCOR}$ to provide the summation SUM. The higher the ERROR, the larger the summation SUM, which increases the amount of coolant being provided from the radiator 21 to the engine 14.

$$\mathrm{SUM}=\mathrm{RATIO}_{UNCOR}+\mathrm{CORR} \quad (10)$$

At 228, the CCV position module 112 determines a position POS of the CCV 28 based on the summation SUM. The position POS may be indicated by a position signal 180. The CCV position module 112 may look-up the position in one of the tables 229 stored in the memory 120 based on the summation SUM. Each of the tables may be for a particular CCV and/or engine. This provides system modularity based on engine type, coolant control valve type, etc. The method may end at 230 or return to task 202.

The above-described method corrects transport delays for temperatures of coolant while controlling mixing of coolant streams via a CCV. The controlled mixing of coolant streams is provided by applying closed loop control of an open loop generated flow rate ratio (e.g., $\mathrm{RATIO}_{UNCOR}$). The method also corrects secondary error sources via closed loop error correction control.

The above-described method controls cylinder combustion wall temperatures by controlling engine inlet temperatures and coolant flow. This includes mixing engine out and radiator out coolants and then mapping temperatures of the coolant being received at the engine to provide a Δt across the engine for best fuel efficiency. A closed loop correction is made for coolant control valve adjustment to account for temperature variations caused by transmission oil cooler, engine oil cooler, and heater core return coolant flows.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" includes: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A system comprising:

a target module configured to, based on an output torque of an engine, determine a target temperature of coolant at an input of the engine to provide a predetermined maximum amount of fuel efficiency without engine knock;

a mode module configured to disable closed loop control of a position of a coolant control valve based on a temperature of coolant entering the engine and a temperature of coolant at an output of a radiator;

an open loop module configured to determine (i) a first temperature of coolant at a first input of the coolant control valve, and (ii) a second temperature of coolant at a second input of the coolant control valve, wherein the first input receives coolant from the radiator, and wherein the second input receives coolant from a channel that bypasses the radiator;

a ratio module configured to determine a ratio based on the temperature of the coolant entering the engine, the temperature of the coolant at the output of the radiator, the first temperature and the second temperature;

a closed loop module configured to, while the closed loop control is enabled, generate a correction value based on the target temperature and the temperature of the coolant entering the engine; and a position module configured to adjust a position of the coolant control valve based on the ratio, the correction value and whether the closed loop control is disabled.

2. The system of claim 1, wherein the target module is configured to determine the target temperature based on a speed of the engine.

3. The system of claim 1, wherein the target module is configured to determine the target temperature of the coolant based on a temperature of coolant at an output of the engine, a speed of the engine and a load on the engine.

4. The system of claim 1, wherein the mode module configured to:

disable the closed loop control such that the coolant control valve is in a fully open position if the detected temperature of the coolant entering the engine is less than or equal to the temperature of the coolant at the output of the radiator; and enable the closed loop control such that the coolant control valve is not in the fully open position if the detected temperature of the coolant entering the engine is greater than the temperature of the coolant at the output of the radiator.

5. The system of claim 4, wherein the position module controls the position of the coolant control valve such that:

coolant is provided from the radiator via the coolant control valve to the engine when the coolant control valve is in the fully open position;

coolant is not provided from the channel via the coolant control valve to the engine when the coolant control valve is in the fully open position; and coolant is provided from both the radiator and the channel and mixed at an output of the coolant control valve when the closed loop control is enabled.

6. The system of claim 1, wherein the open loop module is configured to perform open loop control of the coolant control valve, while the closed loop control is disabled, including:

determining the first temperature of the coolant at the first input of the coolant control valve based on the temperature of the coolant at the output of the radiator and a first delay value; and determining the second temperature of the coolant at the second input of the coolant control valve based on the temperature of the coolant at an output of the engine, wherein position of the coolant control valve is not determined based on the correction value during the open loop control.

7. The system of claim 1, wherein the ratio module is configured to determine the ratio based on (i) a first difference between the temperature of the coolant entering the engine and the temperature of the coolant at the output of the radiator, and (ii) a second difference between the first temperature and the second temperature.

8. The system of claim 7, wherein the ratio module is configured to determine the ratio by dividing the first difference by the second difference to provide a resultant value and subtracting the resultant value from 1.

9. The system of claim 1, wherein the closed loop module is implemented as a proportional integral derivative controller and is configured to (i) generate the correction value based on an error value, and (ii) generate the error value based on a difference between the target temperature and the temperature of the coolant entering the engine.

10. The system of claim 1, further comprising a summation module configured to sum the ratio and the correction value, wherein the position module is configured to determine the position based on the sum of the ratio and the correction value.

11. The system of claim 1, wherein the target module is configured to determine the target temperature of the coolant based on a combustion temperature of the engine.

12. The system of claim 1, wherein:

the closed loop module comprises a proportional integral derivative module; and the proportional integral derivative module is configured to generate the correction value based on the target temperature and the temperature of the coolant entering the engine.

13. A method comprising:

based on an output torque of an engine, determining a target temperature of coolant at an input of the engine to provide a predetermined maximum amount of fuel efficiency without engine knock;

disabling closed loop control of a position of a coolant control valve based on a temperature of coolant entering the engine and a temperature of coolant at an output of a radiator;

determining (i) a first temperature of coolant at a first input of the coolant control valve, and (ii) a second temperature of coolant at a second input of the coolant control valve, wherein the first input receives coolant from the radiator, and wherein the second input receives coolant from a channel that bypasses the radiator;

determining a ratio based on the temperature of the coolant entering the engine, the temperature of the coolant at the output of the radiator, the first temperature and the second temperature;

while the closed loop control is enabled, generating a correction value based on the target temperature and the temperature of the coolant entering the engine; and adjusting a position of the coolant control valve based on the ratio, the correction value and whether the closed loop control is disabled.

14. The method of claim 13, comprising determining the target temperature based on a speed of the engine.

15. The method of claim 13, comprising determining the target temperature of the coolant based on a temperature of coolant at an output of the engine, a speed of the engine and a load on the engine.

16. The method of claim 13, further comprising:

disabling the closed loop control such that the coolant control valve is in a fully open position if the detected temperature of the coolant entering the engine is less than or equal to the temperature of the coolant at the output of the radiator; and enabling the closed loop control such that the coolant control valve is not in the fully open position if the detected temperature of the coolant entering the engine is greater than the temperature of the coolant at the output of the radiator.

17. The method of claim 16, further comprising controlling the position of the coolant control valve such that:

coolant is provided from the radiator via the coolant control valve to the engine when the coolant control valve is in the fully open position;

coolant is not provided from the channel via the coolant control valve to the engine when the coolant control valve is in the fully open position; and coolant is provided from both the radiator and the channel and mixed at an output of the coolant control valve when the closed loop control is enabled.

18. The method of claim 13, further comprising performing open loop control of the coolant control valve, while the closed loop control is disabled, including:

determining the first temperature of the coolant at the first input of the coolant control valve based on the temperature of the coolant at the output of the radiator and a first delay value; and determining the second temperature of the coolant at the second input of the coolant control valve based on the temperature of the coolant at an output of the engine, wherein position of the coolant control valve is not determined based on the correction value during the open loop control.

19. The method of claim 13, comprising determining the ratio based on (i) a first difference between the temperature of the coolant entering the engine and the temperature of the coolant at the output of the radiator, and (ii) a second difference between the first temperature and the second temperature.

20. The method of claim 13, comprising generating the correction value based on an error value and further comprising generating the error value based on a difference between the target temperature and the temperature of the coolant entering the engine.

* * * * *